US005240015A

United States Patent [19]

Rosen et al.

[11] Patent Number: 5,240,015

[45] Date of Patent: * Aug. 31, 1993

[54] WETTED IMPACT BARRIER FOR THE REDUCTION OF TAR AND NICOTINE IN CIGARETTE SMOKE

[76] Inventors: William E. Rosen; David I. Rosen; Adam H. Rosen, all of 2055 Wisteria La., Lafayette Hill, Pa. 19444

[ * ] Notice: The portion of the term of this patent subsequent to Oct. 27, 2009 has been disclaimed.

[21] Appl. No.: 655,070

[22] Filed: Feb. 14, 1991

Related U.S. Application Data

[63] Continuation-in-part of Ser. No. 432,168, Nov. 6, 1989, Pat. No. 5,158,099.

[51] Int. Cl.[5] ..... A24D 1/04; A24D 3/02; A24F 47/00

[52] U.S. Cl. ..... 131/335; 131/329

[58] Field of Search ..... 131/335, 331, 328, 329

[56] References Cited

U.S. PATENT DOCUMENTS 2,217,527 10/1940 Roon ..... 131/362

3,884,246 5/1975 Walker ..... 131/337

*Primary Examiner*—V. Millin

*Assistant Examiner*—J. Doyle

*Attorney, Agent, or Firm*—Aquilino & Welsh

[57] ABSTRACT

This invention is devised to be a free standing wetted impact barrier for dispensing onto a cigarette. Only when applied on the top mouthpiece of cigarette filter types does it become a part of the filter. More particularly, this invention relates to a wetted impact barrier kit which includes a free standing wetted barrier placed in a container with a dispenser and an instruction sheet on how to use the kit. The wetted impact barrier is dispensed on the top end surface of cigarette filter type mouthpiece, to reduce tar and nicotine of cigarettes (total particular matter), when smoked. This invention is designed only to dispense the wetted impact barrier on the top end surface of a mouthpiece of a cigarette filter The wetted impact barrier helps to eliminate or remove the primary tars and nicotine and certain other volatiles from cigarette smoke.

1 Claim, 3 Drawing Sheets

WETTED IMPACT BARRIER FOR THE REDUCTION OF TAR AND NICOTINE IN CIGARETTE SMOKE

RELATED APPLICATIONS

This application is a continuation-in-part of Ser. No. 07/432,168, filed Nov. 06, 1989 now U.S. Pat. No. 5,158,099.

BACKGROUND OF THE INVENTION

1. Field of the Invention

This invention relates to the tobacco art, and more particularly, to a wetted impact barrier which is separate and in no way attached or bound to cigarette filter types until the wetted impact barrier is physically applied to create a wetted impact barrier to the top end surface of cigarette filter mouthpiece where the smoke is drawn through the mouth. Also included is a kit and method of application of said kit to a cigarette in order to reduce the tar and nicotine inhaled by the cigarette smoker. The kit comprising a dispenser with instructions.

2. Description of the Prior Art

There have been attempts to design tar and nicotine reducing elements for tobacco smoke described in the prior art and several of these elements contain means for moistening or humidifying a porous filter. Typically, a frangible module containing water or an aqueous solution is embedded in the filter and the module is compressed to release the liquid before the filter is used. The moistened filter material in the element then exhibits an improved ability to remove the primary tars, nicotine, and certain other volatiles from the smoke.

For example, in U.S. Pat. No. 3,884,246, to Eric E. Walker, a tobacco smoke filter element comprised of a resilient, water impervious elongated tubular casing having a porous plug of filtering material disposed in each end of said casing; opposed, mutually spaced, disc-like walls disposed within said casing between said plugs, one wall within said casing between said plugs and one wall abutting the inner surface of each plug, said walls defining a chamber within the central portion of said casing and having at least one port in each wall. The device further including at least one liquid containing module disposed within said chamber and extending between said walls, wherein said walls have at least one passage for allowing smoke through said filter element and means carried by said element and cooperating between said module and at least one port in each of said walls for directing liquid from said module through the ports into said plugs responsive to compression of the external walls of said chamber so that said plugs may act selectively as a dry filter, or when said casing is compressed, as a filter moistened by said liquid.

In U.S. Pat. No. 3,428,049 to Leake et al., one or more of said modules are surrounded by a compressed filter material in the element. When the module is compressed the liquid saturates the filter material causing it to expand into the space occupied by the module It is made as part of the cigarette, confined to the filter.

In U.S. Pat. No. 3,635,226 to Horsewell et al. a liquid-containing capsule is disposed between an absorbent plug, adjacent the tobacco, and a nonabsorbent plug such that when the capsule is compressed the liquid is released into the absorbent plug. U.S. Pat. No. 3,596,665 to Lundegard also describes a frangible, liquid containing module disposed between two plugs. Compression of this module releases the liquid into both plugs for enhanced filtering.

In addition, many different liquids have been encapsulated within the filter mechanism to moisten the filters. Examples thereof are water, glycerin, and aqueous solutions or emulsions containing aromatic flavoring agents. These liquids act, in the filter, primarily to cool the smoke and to facilitate condensation of volatile components therein on the filter substrate.

The above mentioned filters describe smoke filters containing collapsible or frangible capsules filled with water or other liquids. Filter elements containing liquid pose a problem of retaining the liquid during storage, and those containing capsules or other containers of a liquid often present within the filter structure cause a problem when the liquid is released as the liquid holds the filter element in a collapsed state after pressure on filter has been released.

The aforementioned prior filters lack the desired versatility necessary for widespread acceptance.

In the above mentioned products, the liquid products were incorporated inside the filter or made as an attachment to the filter.

AquaFilter, U.S. Pat. Nos. 4,003,387, 4,046,153 and 3,797,644, are directed to a disposable cigarette holder made of plastic, which has a wet cotton filter on the inside. The wetness is glycerin and water. The holder is attached to the cigarette which draws smoke into and over the wet cotton filter, held together by plastic casing, into the mouth, which caused the smoke to condensate tar and nicotine (total particular matter) on to the fiber wet filter. In this product, it is an attachment. Most smokers object to having a foreign object, such as plastic in their mouth.

As a practical matter, the process of manufacturing and packaging cigarettes and the necessity for storing cigarettes of varying periods of time, have proven to be affected because of damage to filter, drying out, impact or disfiguring of the filter with moisture before being smoked.

Another example, in U.S. Pat. No. 3,319,632 to Henry Burbig, relates to a cigarette moistener device. In this device the interior of the filter tip of a cigarette is moistened. The device is topped by a receptacle and is provided with a hollow needle extending axially thereof, wherein the needle has a number of openings in the side thereof and the hollow needle extends into the moistener container. Where the moistener container is a squeeze bottle with resilient side, the insertion of the filter into the receptacle and squeezing the sides of the moistener container will result in impregnating the inner part of the filter with moisture The utilization of a hollow needle of greatly restricted diameter will meter the amount of moisture thus expressed on a single squeeze, to impregnate the interior of the cigarette filter with water.

SUMMARY OF THE INVENTION

The invention is a wetted impact barrier and a kit with instructions for applying the wet barrier. The barrier is not part of a filter until the colored wet barrier solution is dispensed only on the top end surface of the filter mouthpiece, which is wetted by the person physically applying the wetted impact barrier to the top surface of filter mouthpiece. The top surface of the filter mouthpiece is the only part of the filter that is wetted. It can be dispensed on every cigarette filter type. The solution of this invention becomes a wetted impact barrier only when dispensed upon desire of the user on the top surface of mouthpiece of any filter type cigarettes and then smoked. The wetted impact barrier is always fresh and aqueous and also bacteria free, no dry out characteristics, and this is because it is a separate, free standing component. It is the object to provide the person with a visual way of applying this wetted impact barrier because the solution is added with food coloring which also shows how much is desired for wetted impact barrier. It is still another object to provide the user with a visual condensation of (total particular matter) tar and nicotine on the visual end of the filter mouthpiece when smoked. It is yet another object to have the wetted barrier be a pinkish/red color so the smoker can see the pink turn into a dark brown or black (tars) to give them a sense that the wetted impact barrier is working effectively.

It is another object of this invention to provide a wetted impact barrier which negates the necessity of having to use an attached mouthpiece to house the filter plug or mechanical means inside a cigarette filter as smokers prefer the feel of the soft filter type cigarette against their lips in contrast to a hard mouthpiece.

A primary object of the invention therefore is the provision of a novel wetted impact barrier to be used on the filter tip mouthpiece of a cigarette with a recessed configuration or without a recessed configuration. The foregoing and many other objects of my invention will become apparent in the following description and drawings in which:

DETAILED DESCRIPTION OF THE INVENTION

Figure 1:
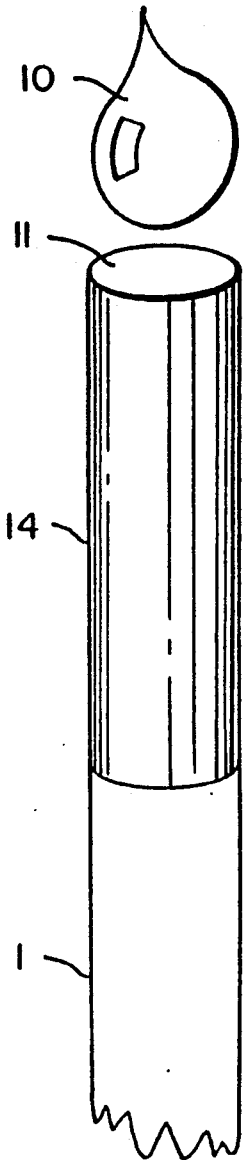
FIG. 1 is a partial perspective view of a cigarette with a drop of wetted impact barrier being applied thereto.

Referring to FIG. 1, a drop 10 of the wetted impact barrier is shown being applied to the top surface of filter mouthpiece.

Figure 2:
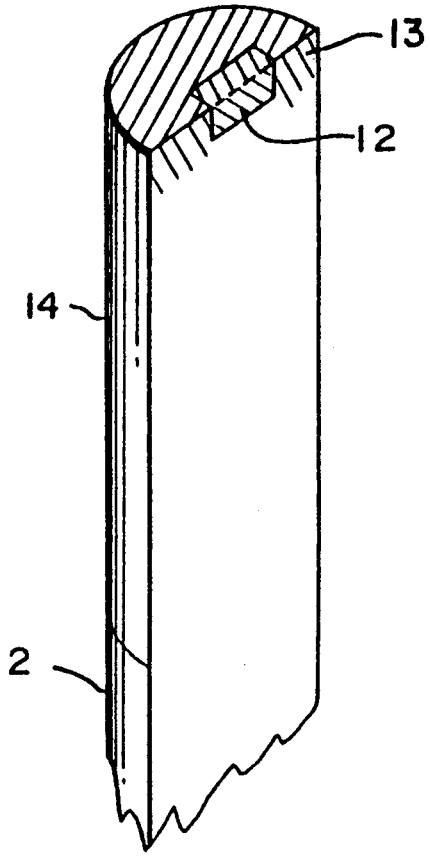
FIG. 2 is a partial cross sectional view of a cigarette having a square-shaped wellular recess.

The wetted impact barrier is not part of a cigarette or cigarette rod, only when the wetted impact barrier is applied physically onto the top surface of cigarette filter mouthpiece does it become part of the cigarette filter The wetted impact barrier is colored so that one can see where the wetted impact barrier is being applied to the top surface of filter mouthpiece. The wetted impact barrier further having a viscosity to coat the end of a cigarette wherein said coating or barrier placed on the end of the cigarette being of sufficient amount to reduce the tar and nicotine produced from the combustion of said product. As best seen in FIG. 2, the wetted impact barrier 13 only coats the very end of the cigarette.

The wetted impact barrier is free standing, and is not any part of a cigarette until physically applied thereto. The preferred color of the wetted impact barrier being a pinkish/red solution which when dispensed on the top surface 11 of filter mouthpiece 14 can be visually seen in order to make sure the top surface is completely covered. The pinkish/red color makes it easier to see where and how much of the wetted impact barrier is being applied to top surface of cigarette filters. The wetted impact barrier may contain syrup type solutions; corn syrups, honey, glycol, petroleum jelly, mineral oil, maple syrup. Any sugar base liquids such as, all fruit syrups, gurgum. All food grade oil, such as, soybean oil, corn oil, pectin. All types of food grade gels. These wetted impact barriers act when applied physically by the user on the top surface of the mouthpiece of all filter types, primarily acts as a barrier, when smoked, causing impact, cooling of the smoke and facilitating condensation of volatile compounds which are able to be seen on the top surface of mouthpiece of cigarettes. We have devised a wetted impact barrier, in which the wetted impact barrier is dispensed on (completely covering) the top surface of the filter before it is placed in the mouth and smoked. The solution acts as a wetted impact barrier on the very top surface of filter plug through which the smoke travels into the mouth. Upon contact with the wetted impact barrier, the smoke is slowed and cooled, which leaves nicotine and tar (Total particular matter) on the top surface of cigarette filter types.

It is furthermore important that the pinkish/red, wetted impact barrier be placed onto the top surface of mouthpiece on the cigarette filter type material so there is no propellent of the wetted impact barrier back into the mouth upon smoking of the cigarette.

In FIG. 2 the open end 11 of the top filter mouthpiece 14 of cigarette 2 shows a square type wellular recess configuration 12. Wetted surface 13 is the impact barrier when wetted on the top surface area of filter 14.

Figure 3:
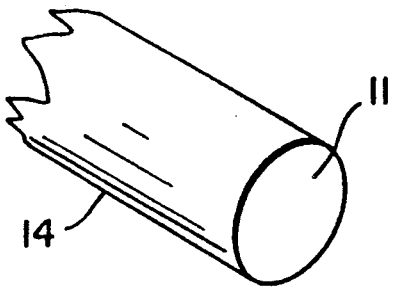
FIG. 3 is a top end view of FIG. 1.

In FIG. 3 the top surface of filter mouthpiece 14 is shown without any recess and without any wetted impact barrier.

Figure 4:
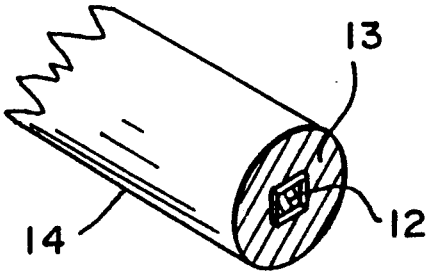
FIG. 4 is a top end view of the cigarette shown in FIG. 2.

The square recess configuration 12 and wetted surface area 13 as shown in FIG. 4 are shown in end view.

Figure 5:
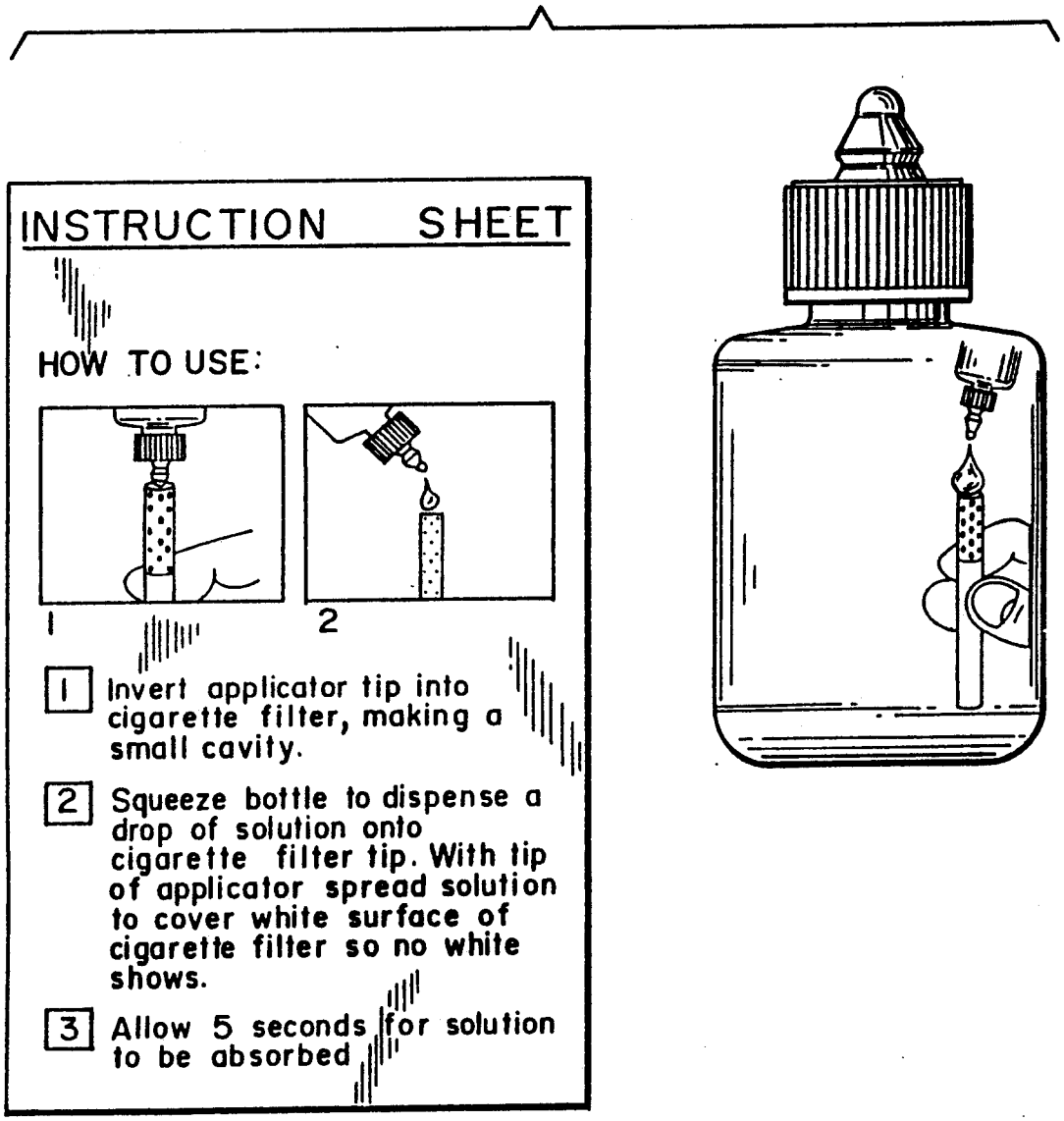
FIG. 5 is a depiction of all the components of the kit.

FIG. 5 illustrates a kit comprising the dispenser and instructions.

Figure 6:
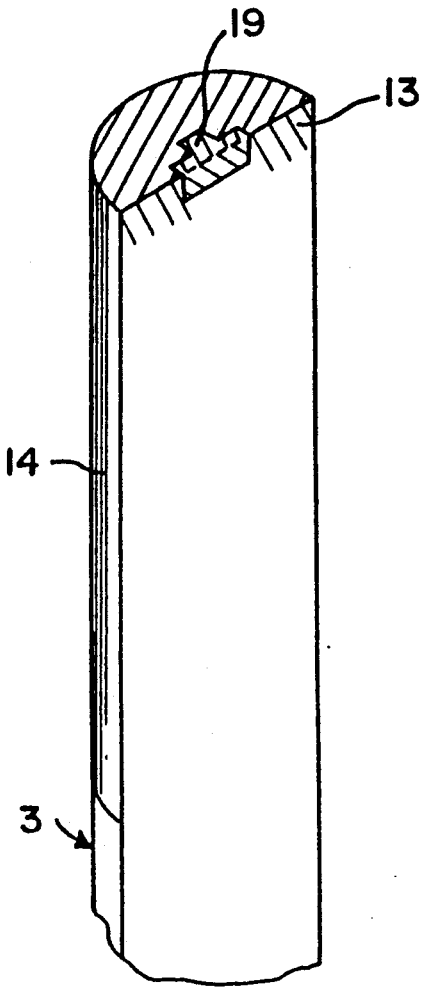
FIG. 6 is a cross sectional view of a cigarette having a cross shaped recess configuration.

FIG. 6 shows the cross section of cigarette 3 and filter 14. Number 13 is the wetted impact barrier covering the top surface of filter mouthpiece 14. Number 19 is a cross shaped recess configuration, wetted by the impact barrier.

Figure 7:
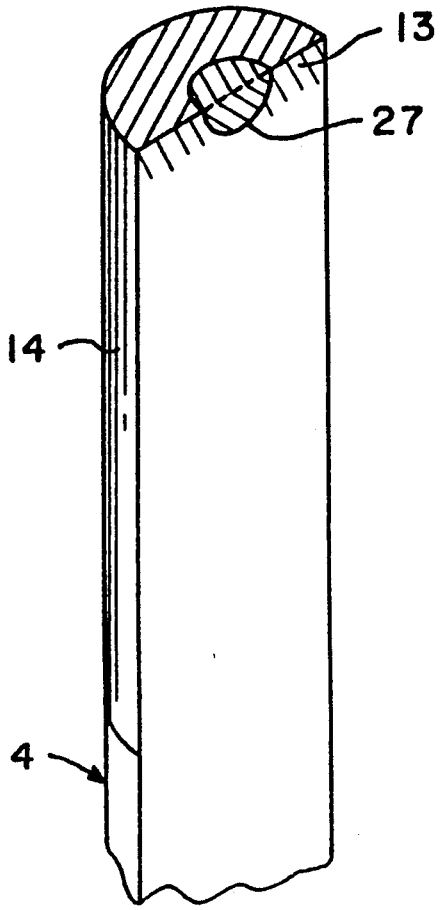
FIG. 7 is a cross sectional view of a cigarette having an oval-shaped recess configuration.

FIG. 7 is the cross section of the cigarette 4 wherein 13 is the wetted impact barrier covering the top surface of filter mouthpiece 14 of cigarette 4. Number 27 is an oval configuration, wellular recess with the wetted impact barrier.

Figure 8:
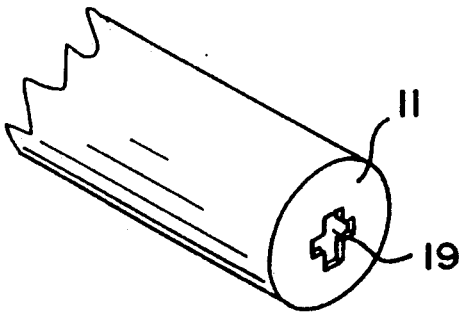
FIG. 8 is a top end view of a cigarette similar to that shown in FIG. 6.

In FIG. 8 the cross shaped recess configuration 19 on the top surface 11 of filter mouthpiece 14 of cigarettes 3 is untouched by any wetted impact barrier. Also the top surface 11 of filter mouthpiece 14 is shown without any wetted impacted barrier being applied.

Figure 9:
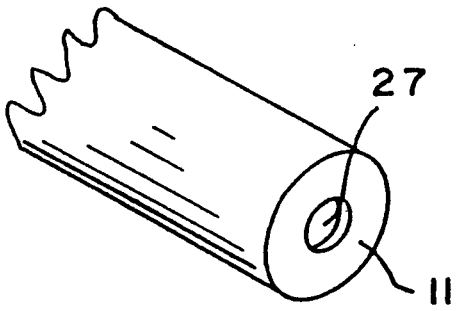
FIG. 9 is a top end view of a cigarette similar to that shown in FIG. 7.

FIG. 9 is an end view showing cigarettes 4 with top surface 11 of filter mouthpiece 14 having no wetted impact barrier applied thereto. Also the circular recess configuration 27 on the top surface 11 of filter mouthpiece 14 has not been touched with any wetted impact barrier.

The following Lab Report results are provided to show how effective the kit, when used as instructed, is in reducing tars and nicotine.

LAB REPORT

Referring to a laboratory report PT 367211 in which we tested Winston ® and Marlboro ® Cigarettes with the wetted impact barrier.

A group of Marlboro ® cigarettes were treated with the wetted impact barrier by applying the wetted impact barrier onto the top surface of mouthpiece onto the filter material before being smoked. The cigarettes were then smoked on a cigarette smoking machine according to the method approved and utilized by the F.T.C. Another group of Marlboro ® Cigarettes were smoked on the cigarette smoking machine, as is (without the wetted impact barrier). Upon accumulation and measurement of the condensate the results were as follows:

| | Without Pinkish/Red Liquid | With Pinkish/Red liquid |
|---|---|---|
| Nicotine | 1.13 | 0.13 |
| Tars | 17.1 | 1.75 |

A group of Winston ® Cigarettes were also treated with the wetted impact barrier by applying the wetted impact barrier onto the top surface of mouthpiece on a conventional cigarette filter type before being smoked. The Winston ® Cigarettes were then smoked on a cigarette smoking machine according to the method approved and utilized by the F.T.C. A group of Winston ® Cigarettes were also smoked on the machine without the wetted impact barrier being applied. Upon accumulation and measurement of the condensate the results were as follows:

| | Without Pinkish/Red Liquid | With Pinkish/Red Liquid |
|---|---|---|
| Nicotine | 1.43 | 0.03 |
| Tars | 19.7 | 0.22 |

As you smoke the cigarette, you will see the pinkish/red wetted impact barrier discolor as it cools smoke and condensates large amounts of tar and nicotine that you would otherwise be inhaling. The reason for the pinkish/red color of the wetted impact barrier is so the user can see just how much of the wetted impact barrier is being applied and allows for equal distribution of the wetted impact barrier on the top surface of mouthpiece.

Not only is the present invention more effective than any of the devices and methods of the known prior art, but it is also inexpensive and easy to use.

While the invention has been described with respect to particular embodiments, the invention should not be deemed limited by these examples The wetted impact barrier can be provided in many forms. Many substances can be substituted for the wetted impact barrier, as stated. It is understood that the invention can thus be modified in many ways, and that such modifications are within the spirit and scope of the following claims:

I claim:

1. A kit for the application of wet impact barrier to the end of the smoking article comprising:

A) a dispenser having a liquid therein that when applied to the end of a cigarette forms a wet impact barrier at the end of said smoking article;

B) means provided on said dispenser for the application of said liquid onto said end of said smoking article; and C) said kit further comprising instructions for the application of said liquid to the end of said smoking article.

* * * * *